US009816273B2

(12) United States Patent
Yi

(10) Patent No.: US 9,816,273 B2
(45) Date of Patent: Nov. 14, 2017

(54) CLIP FOR SECURING REBAR

(71) Applicant: Chris Chae Yong Yi, Diamond Bar, CA (US)

(72) Inventor: Chris Chae Yong Yi, Diamond Bar, CA (US)

( * ) Notice: Subject to any disclaimer, the term of this patent is extended or adjusted under 35 U.S.C. 154(b) by 0 days.

(21) Appl. No.: 14/958,347

(22) Filed: Dec. 3, 2015

(65) Prior Publication Data

US 2016/0108620 A1 Apr. 21, 2016

(51) Int. Cl.
*E04C 5/16* (2006.01)

(52) U.S. Cl.
CPC ..... *E04C 5/167* (2013.01); *E04C 5/16* (2013.01); *E04C 5/168* (2013.01)

(58) Field of Classification Search
CPC ... E04C 5/16; E04C 5/168; E04C 5/18; E04C 5/167
See application file for complete search history.

(56) References Cited

U.S. PATENT DOCUMENTS 1,427,316 A * 8/1922 O'Brien ..... E04C 5/18 52/684
4,110,951 A * 9/1978 Padrun ..... E04C 5/168 403/395
4,132,045 A 1/1979 Sullivan
4,388,791 A 6/1983 Anderson
4,610,122 A 9/1986 Clercq
5,371,991 A 12/1994 Bechtel
5,408,799 A 4/1995 Ron
6,212,848 B1 * 4/2001 Cooper ..... E04C 5/168 404/135
6,837,017 B2 1/2005 Hardy
7,143,563 B1 12/2006 Palmer
7,241,071 B2 7/2007 Carraher
7,377,083 B2 5/2008 McCafferty
D587,564 S 3/2009 Kodi
7,886,498 B2 2/2011 Baruh
8,112,964 B2 2/2012 Baruh
8,117,796 B2 2/2012 Kodi
8,272,184 B2 9/2012 Cech
8,505,267 B2 * 8/2013 Martin Hernandez ... E04B 5/32 52/125.1
8,776,328 B2 7/2014 Kodi
2004/0154261 A1 8/2004 Miller
(Continued)

*Primary Examiner* — Andrew J Triggs
(74) *Attorney, Agent, or Firm* — The Law Office of Scot S. Fagerland

(57) ABSTRACT

The present invention is a clip for securing more than two rebar rods. The rods may be secured in a planar or three-dimensional lattice configuration. In a planar configuration, the clip accommodates two parallel rebar rods and a third rod perpendicular to the first two. Alternatively, the clip may secure three mutually perpendicular rods. The clip is constructed of at least two mutually perpendicular planar surfaces. Each planar surface is recessed in a seat for holding a rod. Each seat has a semicircular arch where the rod sits, with an optional rectangular opening for inserting the rod. In a preferred embodiment, the clip has five seats. Two seats are parallel with a coincident axis in the x-direction. Two other seats are side-by-side with parallel axes in the y-direction. Another seat has an axis in the z-direction. Each rod is held in place by other rods.

2 Claims, 4 Drawing Sheets

(56) References Cited

U.S. PATENT DOCUMENTS

| | | | | |
|---|---|---|---|---|
| 2007/0222209 | A1* | 9/2007 | Rise | E04C 5/166<br>285/148.17 |
| 2010/0212247 | A1* | 8/2010 | Kohl | E04B 2/26<br>52/565 |
| 2012/0233956 | A1 | 9/2012 | Fey | |
| 2015/0068146 | A1* | 3/2015 | Dixon | E04B 2/10<br>52/425 |

* cited by examiner

CLIP FOR SECURING REBAR

1. FIELD OF THE INVENTION

This invention is in the field of construction with concrete and rebar.

2. BACKGROUND OF THE INVENTION

Concrete is reinforced by an embedded mesh of iron or steel rods known as rebar. Many engineers prefer to further stabilize the rebar by securing the rods together. In its simplest and most common form, this is accomplished with wire ties. This invention relates to an improved method of securing rebar rods together for the security of a concrete structure.

3. DESCRIPTION OF RELATED TECHNOLOGY

In the 1970s-1980s, technology for securing rebar rods together progressed from wire ties to thicker resilient wire clips such as Dayton (U.S. Pat. No. 4,132,045) and Anderson (U.S. Pat. No. 4,388,791). Plastic clips appeared by 1986 (Clercq, U.S. Pat. No. 4,610,122). Whereas a wire clip is essentially a folded one-dimensional structure, a plastic clip can be molded as a curved two-dimensional manifold that can fit the contours of one or more rebar rods.

Some clips secure two or more parallel rods. Ron et al, in U.S. Pat. No. 5,408,799, disclose a structure that provides an elongated axis. A plurality of rebar rods are inserted into axially-spaced slots (10). The rods are parallel to one another and perpendicular to the axis of the device.

Other clips secure two perpendicular rods at their intersection. Baruh (U.S. Pat. No. 7,886,498), Bechtel (U.S. Pat. No. 5,371,991), Jiffy-Clip (U.S. Pat. No. 7,241,071), Clercq (U.S. Pat. No. 4,610,122), Dayton (U.S. Pat. No. 4,132,405), Fey (US patent app 2012/0,233,956), Miller (US app 2004/0,154,261), and Palmer (U.S. Pat. No. 7,143,563) are examples.

A few clips may be used alternatively to support two parallel rods or two perpendicular rods. Cech (U.S. Pat. No. 8,272,184) discloses a clip with a base portion "configured to receive plural concrete reinforcing bars thereat in a selected association (for example, either parallel or at 90 degrees to each other depending on the embodiment of the grip)" (Column 2, Line 15). Kodi's family of patents based on U.S. Pat. No. 7,900,419 discloses a clip that may accommodate two perpendicular rods (FIG. 5 of the '419 patent) or two parallel rods (FIG. 6 of the '419 patent). A Kodi clip will not accommodate more than two rods. Furthermore, Kodi clips must be applied with a specially-made pneumatic gun.

To date, there is no known way to secure more than two rebar rods together with one clip. Additionally, some structures benefit from a three-dimensional lattice of rebar rods, and no known clip can secure three mutually perpendicular rods at a single juncture.

4. SUMMARY OF THE INVENTION

The present invention is a novel rebar clip for securing more than two rebar rods together at one intersection. Two of the rods may be parallel to each other. Two or three of the rods may be mutually perpendicular.

The clip has at least two mutually perpendicular planar surfaces. Each surface has at least one seat, with a semicircular portion for retaining a rod. Each seat may also have a rectangular opening in order to set the semicircular portion away from the edge of its surface. In one embodiment, two parallel seats share the same planar surface, and a third seat is perpendicular to the first and second seats. In another embodiment, three mutually perpendicular planar surfaces have three mutually perpendicular seats. It is also possible to combine these structures to have three mutually perpendicular seats and at least one additional seat parallel to one of the first three seats.

In the preferred embodiment, the clip has five seats for accommodating rods. The first and second seats have parallel axes in the z-direction. The axis of the third seat is perpendicular to the axis of the first seat in the x-direction. The axis of the fourth seat is coincident with the axis of the third seat, so that a single rod occupies the third and fourth seats simultaneously. The axis of the fifth seat is perpendicular to the axes of the first and third seats in the y-direction. This structure enables the clip to secure up to four rods in linear, planar, or spatial configuration. When all seats are occupied by rods, the rods restrict one another's freedom of movement.

5. BRIEF DESCRIPTION OF THE DRAWINGS

FIG. 1 is a perspective view of the clip as viewed from the upper front left direction. It shows essentially the entire clip, including all five seats. In this figure, the directions "left, right, upper, and lower" agree with the directions on the page. The direction "rear" is behind the page, and the direction "front" is in front of the page. The x-axis runs from left to right, the y axis runs from the lower to the upper direction, and the z-axis runs from the rear to the front direction.

FIG. 2 is a perspective view of the clip as viewed from the upper rear right direction. It offers a full view of the fifth seat. In this figure, the directions "upper" and "lower" agree with the directions on the page. The "left" side of the clip is on the right side of the page, and the "right" side of the clip is on the left side of the page. The "rear" side of the clip is in front of the page, and the "front" side of the clip is behind the page.

6. DETAILED DESCRIPTION OF THE PREFERRED EMBODIMENTS

Figure 1:
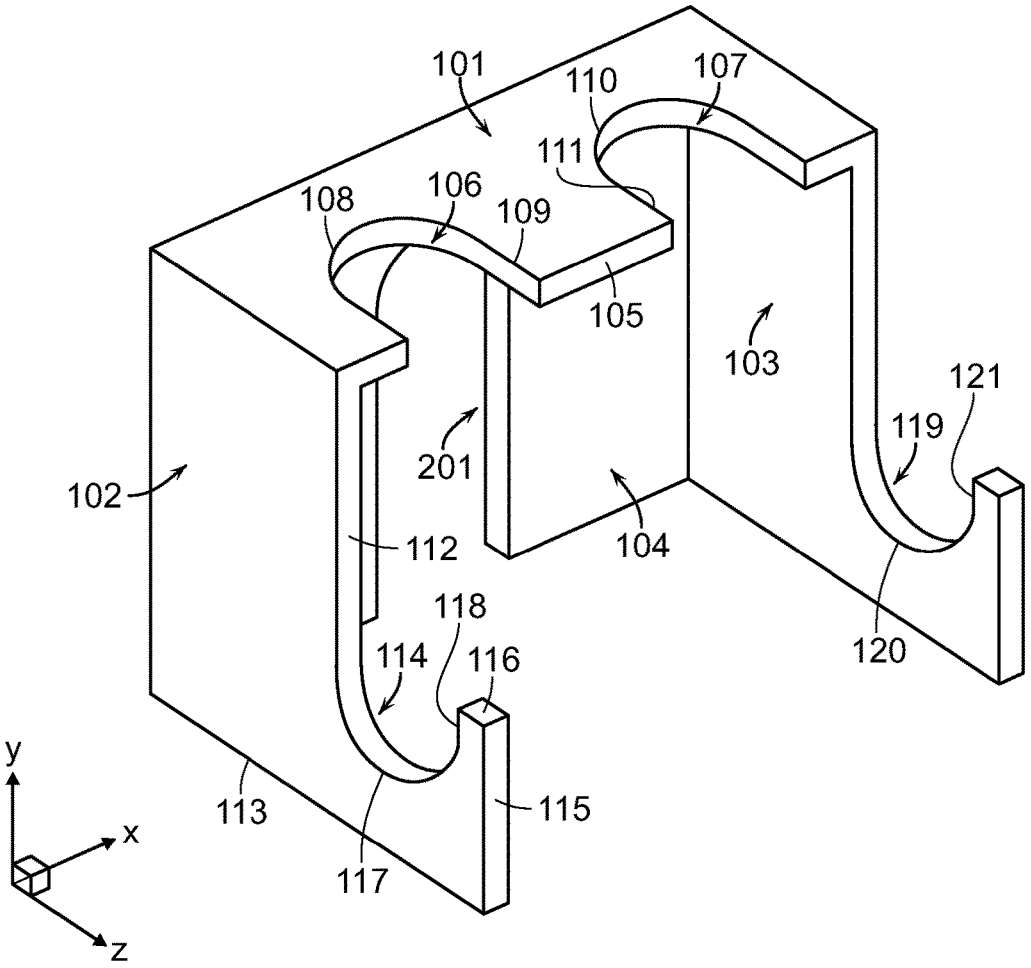

FIG. 1 shows one clip of the preferred embodiment, which has a unitary construction with uniform thickness. It has an upper surface 101, a left surface 102, a right surface 103, and a rear surface 104. The upper surface has a front edge 105. The upper surface is recessed in a first seat 106 and a second seat 107. The first seat has a first semicircular arch 108. The first seat may also include a rectangular opening 109 with the same width as the first semicircular arch, extending from the front edge of the upper surface to the semicircular arch. When the clip is in use, a first rebar rod 302 is inserted into the first seat through the rectangular opening and is held securely by the semicircular arch.

The second seat is congruent to the first seat, with a second semicircular arch 110 and optionally a second rectangular opening 111. The first and second seats are situated side by side on the upper surface, so that their axes are parallel to each other in the y-direction. When the clip is in use, a second rebar rod 303 is inserted into the second seat through the rectangular opening and is held securely by the semicircular arch. The first and second seats are optimally spaced apart by a distance approximately equal to the diameter of each seat, so that a fourth rod 304 may be inserted between the first rod 302 and the second rod 303 from the fifth seat 201.

The left surface 102 has a front edge 112 and a lower edge 113. The front edge of the left surface is coplanar with the front edge of the upper surface. However, the lower edge of the left surface protrudes further forward than the upper surface. A third seat 114 is formed within the left surface. The third seat has a front edge 115 and an upper edge 116. In its negative space, the third seat has a third semicircular arch 117, tangential to the front edge of the left surface. In a preferred embodiment, the third seat also includes a third rectangular opening 118, with the same width as the third semicircular opening, extending from the upper edge of the third seat to the third semicircular opening.

The right surface 103 is congruent to the left surface, with a fourth seat 119 including a fourth semicircular arch 120 and optionally a fourth rectangular opening 121. When the clip is in use, a third rebar rod 301 is secured along the x-axis within the third and fourth seats. The axis of the third rod will therefore be perpendicular to the axes of the first two rods. Because the front edge of the upper surface is flush with the front edge of the left and right surfaces, the rods in the y-direction will be held securely in place by the rod in the x-direction.

Figure 2:
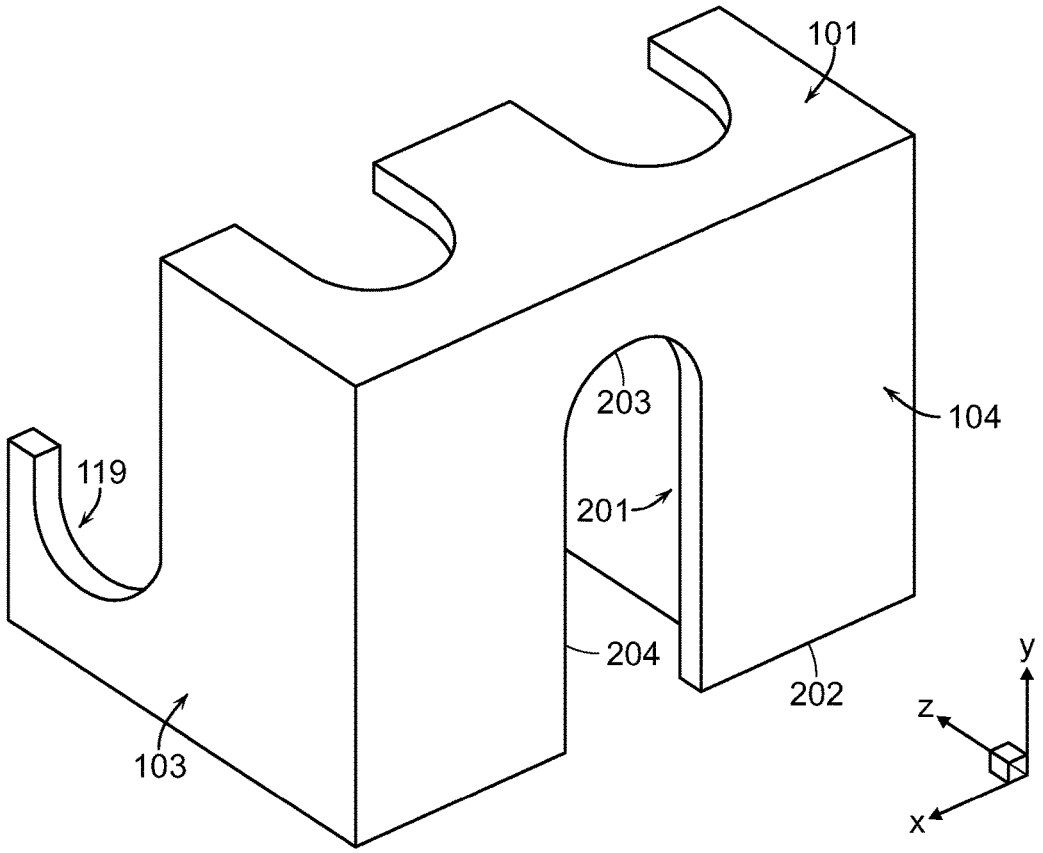
Figure 3:
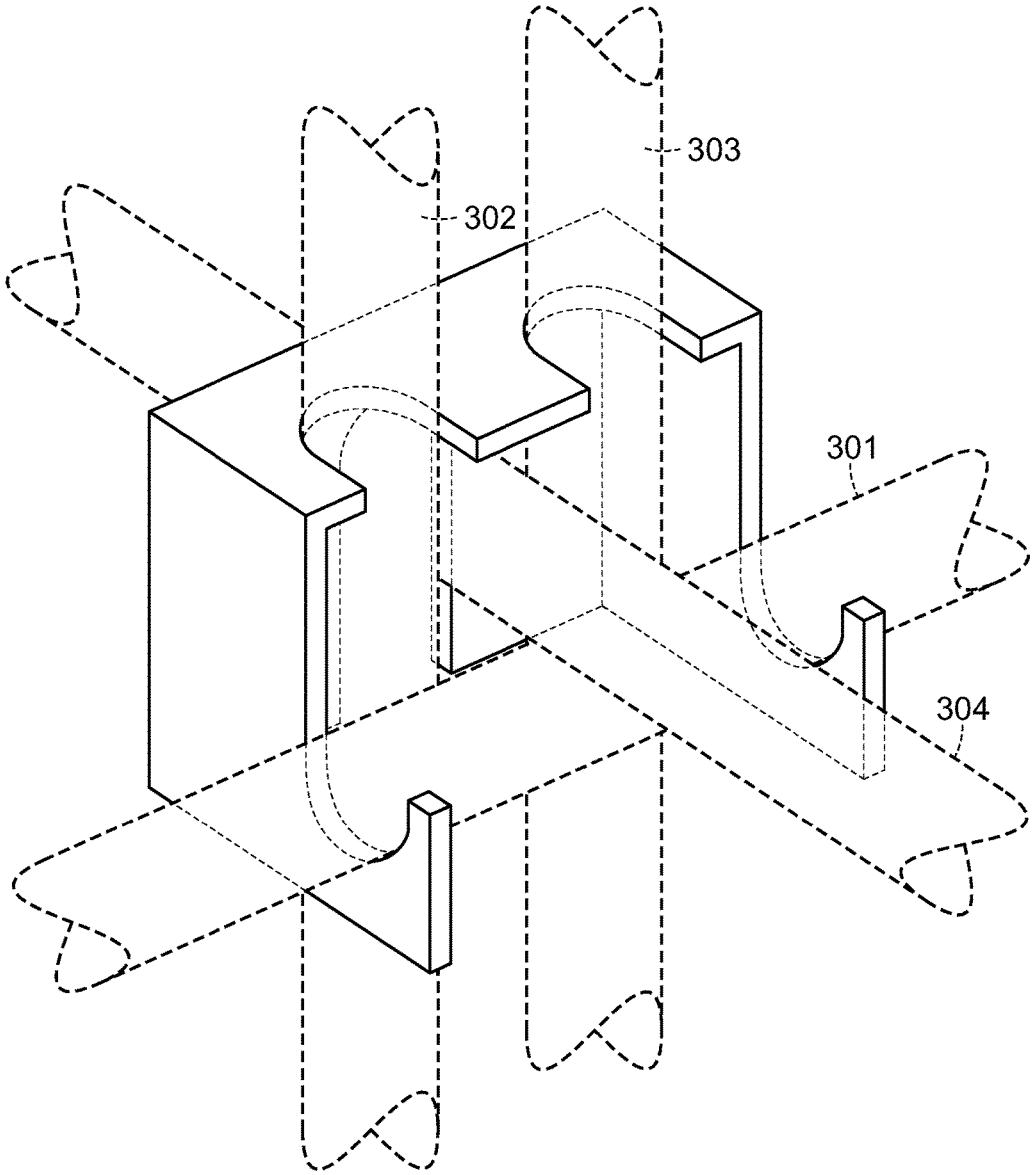
FIG. 3 is a first perspective drawing of the clip securing three rods of rebar. The rebar is not part of the claimed invention, and is drawn with broken lines.
Figure 4:
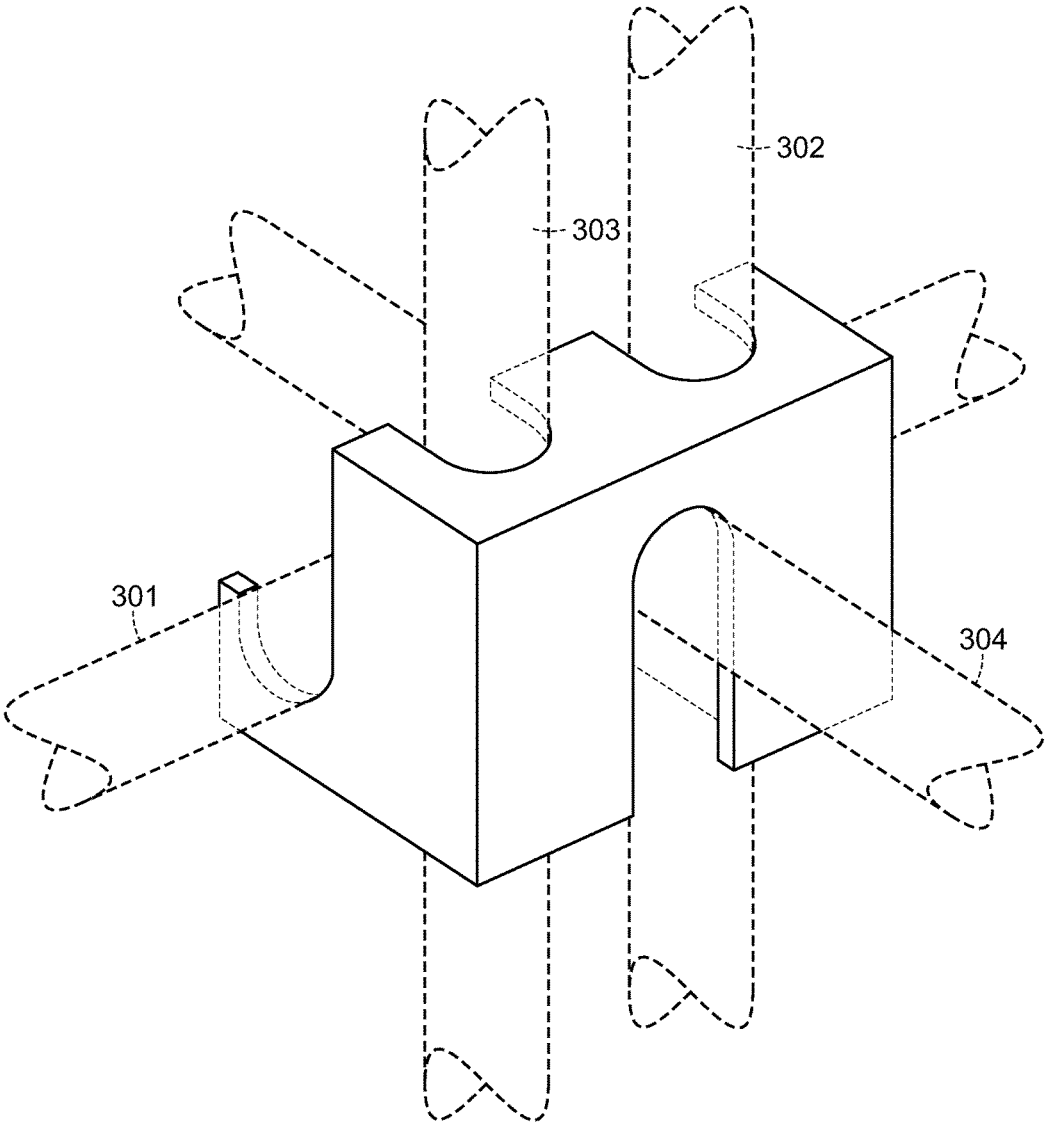
FIG. 4 is a second perspective drawing of the clip securing three rods of rebar. The rebar is not part of the claimed invention, and is drawn with broken lines.

The rear surface 104 is best seen in FIG. 2. The physical construction of the rear surface includes a lower edge 202, which may or may not be coplanar with the lower surfaces of the left edge 102 and right edge 103. The negative space of the rear surface forms the fifth seat 201, with axis in the z-direction. The fifth seat includes a fifth semicircular arch 203 and optionally a fifth rectangular opening 204, with the same width as the fifth semicircular arch and extending from the lower edge of the rear surface to the fifth semicircular arch. When the clip is in use, a fourth rebar rod 304 is inserted through the fifth rectangular opening and held securely in the z-direction. The axis of the fifth seat is optimally between the axes of the first and second seats, so that the rod in the z-direction will be held securely between the rods in the y-direction.

With this novel configuration, rebar rods in all three dimensions are accommodated by a single clip in such a manner that they all hold each other securely in place.

SUMMARY OF PARTS

101=Upper surface
102=Left surface
103=Right surface
104=Rear surface
105=Front edge of upper surface
106=First seat
107=Second seat
108=Semicircular arch of first seat
109=Rectangular opening of first seat
110=Semicircular arch of second seat
111=Rectangular opening of second seat
112=Front edge of left surface
113=Lower edge of left surface
114=Third seat
115=Front edge of third seat
116=Upper edge of third seat
117=Semicircular arch of third seat
118=Rectangular opening of third seat
119=Fourth seat
120=Semicircular arch of fourth seat
121=Rectangular opening of fourth seat
201=Fifth seat
202=Lower edge of rear surface
203=Semicircular arch of fifth seat
204=Rectangular opening of fifth seat
301=Third rod, in the x-direction
302=First rod, in the y-direction
303=Second rod, in the y-direction
304=Fourth rod, in the z-direction

I claim:

1. A clip for securing rebar rods, comprising:

an upper planar surface, which includes a front edge;

a left planar surface, intersecting the upper planar surface at a right angle, which includes an upper left front edge coplanar with the front edge of the upper planar surface, and a lower left extension that extends further forward than the upper left front edge;

a right planar surface, intersecting the upper planar surface at a right angle, which includes an upper right front edge coplanar with the front edge of the upper planar surface, and a lower right extension that extends further forward than the upper right front edge;

a rear planar surface intersecting the left, right, and upper planar surfaces at right angles;

a first seat in the lower left extension, comprising a first semicircular arch tangent to the upper left front edge, with a first axis and a first diameter;

a second seat in the lower right extension, comprising a second semicircular arch tangent to the upper right front edge, sharing the first axis, and with a second diameter;

a third seat in the rear planar surface, comprising a third semicircular arch with a second axis perpendicular to the first axis and with a third diameter;

a fourth seat in the upper planar surface, comprising a fourth semicircular arch with a fourth axis perpendicular to the first and second axes and with a fourth diameter;

a fifth seat in the upper planar surface, congruent to the fourth seat, with a fifth axis parallel to the fourth axis, and with a fifth diameter.

2. The clip of claim 1, wherein:

the first seat further comprises a first rectangular opening with a width equal to the first diameter;

the second seat further comprises a second rectangular opening with a width equal to the second diameter;

the third seat further comprises a third rectangular opening with a width equal to the third diameter;

the fourth seat further comprises a fourth rectangular opening with a width equal to the fourth diameter;

the fifth seat further comprises a fifth rectangular opening with a width equal to the fifth diameter.

* * * * *